US010329514B2

(12) United States Patent
Shevchenko et al.

(10) Patent No.: US 10,329,514 B2
(45) Date of Patent: Jun. 25, 2019

(54) ENZYMATIC DEGUMMING

(71) Applicant: ALFA LAVAL CORPORATE AB, Lund (SE)

(72) Inventors: Alexey Shevchenko, Copenhagen (DK); Ling Hua, Soborg (DK)

(73) Assignee: ALFA LAVAL CORPORATE AB, Lund (SE)

( * ) Notice: Subject to any disclaimer, the term of this patent is extended or adjusted under 35 U.S.C. 154(b) by 326 days.

(21) Appl. No.: 14/439,589

(22) PCT Filed: Oct. 31, 2012

(86) PCT No.: PCT/EP2012/071568

§ 371 (c)(1),
(2) Date: Apr. 29, 2015

(87) PCT Pub. No.: WO2014/067569

PCT Pub. Date: May 8, 2014

(65) Prior Publication Data

US 2015/0284658 A1 Oct. 8, 2015

(51) Int. Cl.

| | |
|---|---|
| ***C11B 3/00*** | (2006.01) |
| ***C11B 3/04*** | (2006.01) |
| ***C11B 3/10*** | (2006.01) |
| ***C11B 7/00*** | (2006.01) |

(52) U.S. Cl.

CPC ..... *C11B 3/003* (2013.01); *C11B 3/001* (2013.01); *C11B 3/04* (2013.01); *C11B 3/10* (2013.01); *C11B 7/0075* (2013.01)

(58) Field of Classification Search

CPC ..... C10G 73/28; C10G 73/25; C11B 3/003; C11B 3/001

See application file for complete search history.

(56) References Cited

U.S. PATENT DOCUMENTS

| | | | | |
|---|---|---|---|---|
| 4,545,940 | A * | 10/1985 | Mutoh | B01D 61/14 554/211 |
| 5,066,504 | A * | 11/1991 | Asbeck | C11B 3/008 426/417 |
| 5,558,781 | A | 9/1996 | Buchold et al. | |
| 7,494,676 | B2 | 2/2009 | Chakrabarti et al. | |
| 2004/0005399 | A1* | 1/2004 | Chakrabarti | C11B 3/003 426/601 |
| 2008/0182322 | A1* | 7/2008 | Dayton | C11B 3/003 435/271 |
| 2009/0306419 | A1 | 12/2009 | Myong et al. | |
| 2010/0240917 | A1 | 9/2010 | Kellens et al. | |

FOREIGN PATENT DOCUMENTS

| | | | | |
|---|---|---|---|---|
| CN | 1659259 | A | 8/2005 | |
| CN | 101432409 | A | 5/2009 | |
| CN | 101485365 | A | 7/2009 | |
| CN | 102399627 | A | 4/2012 | |
| EP | 0110651 | * | 11/1983 | C10G 73/06 |
| EP | 1 876 222 | A1 | 1/2008 | |
| EP | 2 592 133 | A1 | 5/2013 | |
| GB | 382946 | | 10/1932 | |
| RU | 2 347 804 | C2 | 2/2009 | |
| WO | WO 03/102118 | A2 | 12/2003 | |
| WO | WO 2005/063950 | A1 | 7/2005 | |
| WO | WO 2008/094847 | A1 | 8/2008 | |
| WO | WO 2011/046815 | A1 | 4/2011 | |

OTHER PUBLICATIONS

English translation of the Russian Office Action and Search Report, dated Jul. 4, 2016, for Russian Application No. 2015120597.

English translation of the Chinese Office Action and Search Report for Chinese Application No. 201280076735.1, dated Apr. 26, 2016.

Clausen, "Enzymatic oil-degumming by a novel microbial phospholipase", European Journal of Lipid Science and Technology, WILEY-VCH Verlag GmbH, Weinheim, DE, Jun. 1, 2001, vol. 103, No. 6, pp. 333-340, the whole document.

International Search Report, issued in PCT/EP2012/071568, dated Jul. 1, 2013.

Roy et al., "Enzymatic Degumming of Rice Bran Oil", Journal of the American Oil Chemists' Society, Springer, DE, Aug. 1, 2002, vol. 79, No. 8, pp. 845-846, p. 845.

Written Opinion of the International Searching Authority, issued in PCT/EP2012/071568, dated Jul. 1, 2013.

* cited by examiner

*Primary Examiner* — Jonathan M Hurst

(74) *Attorney, Agent, or Firm* — Birch, Stewart, Kolasch & Birch, LLP

(57) ABSTRACT

The present invention relates to a method for treating vegetable oils and/or animal fats. The method comprises adjusting temperature, treatment with acid, adjusting pH, contacting the aqueous mixture with enzyme, crystallization of high melting glycerides and separation.

21 Claims, No Drawings

ENZYMATIC DEGUMMING

The present invention relates to a method for treating vegetable oils and/or animal fats.

BACKGROUND

Most crude edible fatty oils—of vegetable or animal origin—contain impurities which must be removed before the oil is suitable for consumption. Also fatty oils for technical use often have to be purified to some extent to make them suitable for their purpose.

The removing of impurities could be carried out by a degumming and/or winterization process and may be combined into one process a so-called cold degumming process. However, the traditional cold degumming process is not always successful because:

The separation efficiency is relatively low because of the increased gum viscosity at low temperatures;

The wax crystallization and the crystal growth are, to some extent, inhibited by the presence of gums.

THE INVENTION

Accordingly, the present invention solves the above mentioned technical problems by the new inventive method. Thus, the present invention relates to a new method for treating vegetable oils and/or animal fats to reduce the content of impurities, such as various phospholipids i.e. gums, wax and/or high melting glycerides. One aspect of the invention to provide a method for efficiently removing both the phospholipids and the high melting glycerides by phospholipase at the same time. Another aspect of the invention to provide a method for utilizing the enzyme reaction feature such as the reacted gum has lower viscosity and less emulsification strength to achieve less oil loss.

The main purpose of a degumming process is to remove phospholipids from the oil. For some oil types such as sunflower seed oil, rice bran oil, corn oil, winterization process is needed to remove the high melting glycerides to avoid problems in the use of the oils at lower temperature or in later process.

The enzymatic degumming process has been proven effective in gum removal. In degumming processes, the phospholipids are converted to lyso-phospholipids and free fatty acids i.e. FFA. The lyso-phospholipids have much less emulsion capacity and lower viscosity. So, it is expected that the separation at lower temperature in enzymatic degumming process is much better than in a conventional process.

On the other hand, since the lyso-phospholipids are water-soluble, it is expected that most lyso-phospholipids will stay in the water phase during wax crystallation and crystal growth, so that the inhibition due to the presence of gums is eliminated.

In short, the cold enzymatic degumming process will provide the possibility of making degumming and dewaxing simultaneously, and with significant low loss of neutral oil The new method for treating vegetable oils and/or animal fats according to the invention, comprises the following steps:

(i) adjusting the vegetable oils and/or animal fats to a temperature within the range from about 20 to about 90° C., preferably within the range from about 40 to about 90° C.;

(ii) pre-treating the vegetable oils and/or animal fats with acid for at least 1 minutes;

(iii) adjusting the pH with lye to a pH within a range from about 4 to about 8 at a temperature of at least 20° C. obtaining an aqueous mixture, preferably at a temperature of at least 40° C.;

(iv) adding enzymes to the aqueous mixture;

(v) reducing the temperature of the aqueous mixture to crystallization temperature of high melting glycerides;

(vi) separating the aqueous mixture into an aqueous phase and a treated vegetable oils and/or treated animal fats phase; and (vii) optionally treating the treated vegetable oils and/or treated animal fats phase with hot water or with silica adsorption.

In step (i) the temperature of the vegetable oils and/or animal fats may be adjusted within the range from about 60 to about 90° C.

In the pre-treating step (ii) the vegetable oils and/or animal fats may be treated with acid from about 1 to about 60 minutes, preferably from about 5 to about 60 minutes, most preferred from about 20 to about 40 minutes.

The pH in step (iii) may be adjusted with lye to a pH within a range from about 4 to about 8 at a temperature preferably from about 40 to about 60° C. The lye in step (iii) is selected from the group consisting of sodium hydroxide, potassium hydroxide, sodium silicate, sodium carbonate, calcium carbonate, and a combination thereof, preferably sodium hydroxide or potassium hydroxide. According to the invention the mixing of the lye in step (iii) may be continued within the range from about 1 min to about 4 hours.

The temperature of the aqueous mixture in step (v) may be adjusted by a cooling rate and by a residence time to optimize crystallisation, preferably by a cooling rate within the range of from about 0.5 degrees per hour to about 5 degrees per hour, and a residence time within the range of from about 4 to 24 hours, preferably from 6 to 12 hours.

The temperature of the aqueous mixture in separation step (vi) may be adjusted to facilitate separation, preferably the temperature is within the range of from about 15 to about 50° C.

The enzyme in treatment step (iv) may be a phospholipase enzyme, preferably one or more phospholipase A enzymes, or one or more phospholipase C enzymes, or a combination thereof.

The acid used in step (ii) is selected from the group consisting of phosphoric acid, acetic acid, citric acid, tartaric acid, succinic acid, and a mixture thereof, preferrably phosphoric acid or citric acid.

Further aspects and embodiments of the invention are defined by the sub-claims. The invention will be further illustrated in the Examples, which are for the purpose to clarifying the invention and not to limit its scope. If not otherwise stated in the examples and tables the percentage is given by percent by weight (wt %).

EXAMPLE 1

The equipment used in this experiment was an oil bath, Erlenmeyer flasks 500 ml, magnetic stirrer with heating and temperature control, an Ultra Turrax, a laboratory centrifuge. FFA is analyzed according to method according to American Oil Chemists' Society, AOCS, Ca 5a-40, moisture is analyzed according to method AOCS Ca 2b-38, and phosphorus is analyzed according to method DIN EN 14107.

Materials used were:

1. Citric acid, monohydrate
2. Sodium Hydroxide, dry

3. Enzyme, Lecitase Ultra®, i.e. a phospholipase A enzyme.
4. Water

The crude sunflower seed oil was heated in oven to 70° C. to ensure all the wax crystals are melted and dissolved in the oil. Two 500 ml. Erlenmeyer flasks, A and B, were used, one for normal enzymatic deep degumming (A) and the other for cold enzymatic deep degumming (B). To each Erlenmeyer flasks were 250 g of oil were added, and the flasks were placed in a 55° C. oil bath. The oil was stirred with a magnetic rod during the whole reaction, i.e. approx. 350 rpm.

A citric acid solution, i.e. 5 ml, was prepared by dissolving 1.78 g citric acid monohydrate in distilled water. A sodium hydroxide solution was prepared, i.e. 5 ml, by dissolving 0.5075 g sodium hydroxide pellets in distilled water.

To each flask were 0.5 ml of citric acid solution added, and the mixture were mixed by using an Ultra Turrax at high speed, approx. 24000 rpm, for ½ min. After 1 hour 0.5 ml of NaOH solution were added and the mixtures were mixed with an Ultra Turrax for ½ min. To each flask were 0.012 ml of enzyme added together with water summing up to a total of 6 ml for each sample, and the mixing continued for additional ½ min.

After 3 hours of enzyme treatment, the oil bath for flask A is heated to 80° C. to inactivate the enzyme; while flask B was moved together with the magnetic agitator to fridge (7-8° C.), and the agitation was kept at ca. 40 rpm for an overnight.

After ½ hour heating at 80° C., the oil from flask A for 5 min was centrifuged at 2000×g. The moisture, FFA and phosphorus content in the light phase (oil phase) were analysed.

After an overnight agitation in the fridge, flask B and the magnetic agitator were removed from the fridge, and the agitation was kept at room temperature (about 22° C.) for ca. 15 min. The oil from flask B was centrifuged for 5 min. at 2000×g and the moisture, FFA and phosphorus content in the light phase were analysed.

The residual phosphorus content in the degummed oil is about 1 ppm only, which implies the degumming in both samples is complete.

TABLE

| Analysis | Crude oil | Sample A | Sample B |
|---|---|---|---|
| Acid value [mg KOH/g] | 0.84 | 0.85 | 0.82 |
| Moisture [mg/kg] | 947 | 1342 | 669 |
| Phosphorous [mg/kg] | 265 | 0.9 | 1.1 |

On the other hand, it was found some wax was removed together with the gum from the oil in the cold enzymatic deep degumming (B) sample after centrifuge separation. However, the amount of wax was not analyzed in this experiment.

Conclusion: The sunflower seed oil is successfully degummed in the cold enzymatic degumming process. Even though the separation temperature is much lower than that in ordinary degumming process, the residual phosphorus content in cold enzymatic degummed oil is at the same level as in the ordinary degummed oil.

EXAMPLE 2

The process according Example 1 is repeated on another batch of sunflower oil which is a mixture of crude sunflower oil and water degummed sunflower oil. It contains 177 ppm phosphorus and min. 1000 ppm wax. The result of the two samples—normal enzymatic deep degumming (A) and the other for cold enzymatic deep degumming (B) is summarized in the table below.

TABLE 2

| Analysis | Crude oil | Sample A | Sample B |
|---|---|---|---|
| Acid value [mg KOH/g] | 2.10 | 2.19 | 2.21 |
| Phosphorous [mg/kg] | 177 | 8 | 10 |
| Wax [mg/kg] | 1000* | 1000* | 152 |

*The instrument can only analyze the wax content up to 1000 ppm.

Conclusion: The sunflower oil is successfully degummed and dewaxed in the cold enzymatic degumming process. The residual wax in degummed oil is less than 15% of feed oil.

The invention claimed is:

1. A method for treating vegetable oils and/or animal fats, comprising the following steps:

(i) adjusting the vegetable oils and/or animal fats to a temperature within a range from about 20 to about 90° C.;

(ii) pre-treating the vegetable oils and/or animal fats with acid for at least 1 minute;

(iii) adjusting a pH of the pretreated vegetable oils and/or animals fats with lye to a pH within a range from about 4 to about 8 at a temperature of at least 20° C. to obtain an aqueous mixture;

(iv) adding enzymes to the aqueous mixture to form lysophospholipids and free fatty acids from phospholipids in the aqueous mixture;

(v) reducing a temperature of the aqueous mixture comprising the lysophospholipids and the free fatty acids obtained in step (iv) to a crystallization temperature of high melting glycerides and conducting centrifugation;

(vi) separating the aqueous mixture into an aqueous phase and a treated phase comprising treated vegetable oils and/or treated animal fats; and (vii) optionally treating the treated phase with hot water or with silica adsorption.

2. The method according to claim 1, wherein the temperature in step (i) is adjusted within a range from about 40 to about 90° C.

3. The method according to claim 1, wherein in the pre-treating step (ii) the vegetable oils and/or animal fats is treated with acid from about 1 to about 60 minutes.

4. The method according to claim 1, wherein the pH in step (iii) is adjusted with the lye to a pH within a range from about 4 to about 8 at a temperature from about 40 to about 60° C.

5. The method according to claim 1, wherein the temperature of the aqueous mixture in step (v) is adjusted by a cooling rate and by a residence time to optimize crystallisation.

6. The method according to claim 1, wherein a temperature of the aqueous mixture in separation step (vi) is adjusted to facilitate separation.

7. The method according to claim 6, wherein the temperature of the aqueous mixture in separation step (vi) is adjusted to within the range of from about 15 to about 50° C.

8. The method according to claim 1, wherein the enzyme in treatment step (iv) is a phospholipase enzyme.

9. The method according to claim 1, wherein the acid in step (ii) is selected from the group consisting of phosphoric acid, acetic acid, citric acid, tartaric acid, succinic acid, and a combination thereof.

10. The method according to claim 1, wherein the temperature in step (i) is adjusted to be within the range from about 60 to about 90° C.

11. The method according to claim 1, wherein the mixing of enzyme in step (iv) is continued within the range from about 1 min to about 6 hours.

12. The method according to claim 1, wherein the mixing of the lye in step (iii) is continued within the range from about 1 min to about 4 hours.

13. The method according to claim 1, wherein the lye in step (iii) is selected from the group consisting of sodium hydroxide, potassium hydroxide, sodium silicate, sodium carbonate, calcium carbonate, and a combination thereof.

14. The method according to claim 1, wherein in the pre-treating step (ii) the vegetable oils and/or animal fats is treated with acid from about 5 to about 60 minutes.

15. The method according to claim 1, wherein in the pre-treating step (ii) the vegetable oils and/or animal fats is treated with acid from about 20 to about 40 minutes.

16. The method according to claim 1, wherein the temperature of the aqueous mixture in step (v) is adjusted by a cooling rate within a range of from about 0.5° C. per hour to about 5° C. per hour, and a residence time within a range of from about 4 to 24 hours.

17. The method according to claim 1, wherein the temperature of the aqueous mixture in step (v) is adjusted by a cooling rate within a range of from about 0.5° C. per hour to about 5° C. per hour, and a residence time within a range of from 6 to 12 hours.

18. The method according to claim 1, wherein the enzyme in treatment step (iv) is selected from the group consisting of a phospholipase A enzyme, a phospholipase C enzyme, and combinations thereof.

19. The method according to claim 1, wherein the acid in step (ii) is selected from the group consisting of phosphoric acid and citric acid and combinations thereof.

20. The method according to claim 1, wherein the lye in step (iii) is selected from the group consisting of sodium hydroxide, potassium hydroxide and combinations thereof.

21. The method according to claim 1, wherein the enzymes comprise phospholipase A, and phospholipase C is not present.

* * * * *